United States Patent [19]

Carraroli et al.

[11] Patent Number: 4,527,974

[45] Date of Patent: Jul. 9, 1985

[54] CERAMIC ROLLER-HEARTH KILN WITH CONTROLLED COMBUSTION AND COOLING

[76] Inventors: Dario Carraroli, Via Tiraboschi, 46, 41100 Modena; Giordano Giavelli, Piazza Salvo D'Acquisto, 12, 41049 Sassuolo (Modena), both of Italy

[21] Appl. No.: 433,731

[22] Filed: Oct. 12, 1982

[30] Foreign Application Priority Data

Oct. 14, 1981 [IT] Italy ..... 46893 A/81

[51] Int. Cl.[3] ..... F27D 15/02; F27B 3/04

[52] U.S. Cl. ..... 432/78; 432/128; 432/176; 432/145

[58] Field of Search ..... 432/77, 78, 83, 144, 432/145, 152, 163, 164, 171, 173, 189, 196, 128, 133

[56] References Cited

U.S. PATENT DOCUMENTS 3,172,647 3/1965 Remmey ..... 432/145
3,705,620 12/1972 Kayatz ..... 432/78
4,047,886 9/1977 Heyrand ..... 432/128
4,249,895 2/1981 Mantegani ..... 432/78
4,285,669 8/1981 Walchhutter ..... 432/176

*Primary Examiner*—Henry C. Yuen
*Attorney, Agent, or Firm*—Brisebois & Kruger

[57] ABSTRACT

The ceramic roller-hearth kiln is divided into three zones, of which the first and last are utilized for the initial heating and the cooling of the material respectively, and the central zone, which is provided with combustion means and utilized for high-temperature firing, comprises a conduit for the forced counter-current suction of the gaseous products of combustion between said second and said first zone, from said conduit there branching two ducts for the feed and recovery of part of the hot gas to and from the first zone; the cooling zone being constituted by three successive sections comprising, respectively, direct cooling by blowing air on to the material, cooling by induction and cooling by forced ventilation, the hot air recovered from said cooling zones being fed to the head of the kiln, to flow into said forced suction conduit.

8 Claims, 8 Drawing Figures

CERAMIC ROLLER-HEARTH KILN WITH CONTROLLED COMBUSTION AND COOLING

DESCRIPTION

The ceramic tile manufacturing industry widely uses roller-hearth kilns, or so-called single-layer kilns, which are fed with an alignnent of transverse rows of tiles which lie directly on the roller table and move forward thereon. Known roller-hearth kilns comprise a suitably driven horizontal roller table disposed inside a tunnel of refractory material, on the side walls of which there is provided a plurality of burners, usually of the gas type, located both below and above the roller table. Starting from the upstream or loading end, said tunnel generally comprises an initial temperature raising zone, an intermediate high temperature zone for firing the material, and a terminal zone for cooling the already fired material directed to discharge.

In such known roller-hearth kilns, the products of combustion are drawn-out countercurrently to the direction of transfer of the material, at the head of the kiln where the material to be fired enters.

Furthermore, for cooling the material directed towards discharge, such kilns comprise two longitudinal overlying sets of fans which feed a large quantity of atmospheric air on to the fired material, both from above and from below it.

Along the tunnel of such known kilns, in particular along their service ducts, valves are provided for regulating the operation of the kiln, for example when material gaps occur along the roller table.

As is widely known in this specific industry, the optimum or theoretical firing curve for a ceramic material such as a tile comprises two critical zones, namely that at the beginning and that at the end of the firing cycle, where the material begins to heat up and cool down respectively. In order to ensure maximum thermal efficiency while as far as possible satisfying the shape requirements of said theoretical firing curve, the aforesaid roller-hearth kilns have their intake for the products of combustion located at the upstream end of the tunnel, and also comprise a long bank of fans feeding a large quantity of atmospheric air on to the material directed towards discharge.

This known kiln structure possesses however a series of drawbacks as follows.

Firstly, the fact that the products of combustion are drawn in from the beginning of the kiln greatly limits the possibility of controlling the tile heating in the first kiln zone, thus making it difficult to satisfy the most appropriate theoretical firing curve for the particular case.

Furthermore, feeding a large quantity of atmospheric air into the kiln cooling zone negatively influences the zones adjacent to the cooling zone, in particular the immediately upstream zone or high-temperature firing zone.

This forced feed of a large volume of air into the kiln cooling zone produces an overpressure, which causes cold air to spill into the high-temperature zone immediately upstream, leading to a higher fuel consumption in order to maintain the required temperature in said zone.

The direct cooling air which spills into the combustion zone thus changes the temperature distribution or temperature curve along the combustion zone, sometimes to a considerable extent.

In addition, besides changing the temperature distribution, said air excess also constitutes a further mass, whether material is present or temporary absent, and absorbs heat to thus increase the fuel consumption in the aforesaid single-layer kilns.

In order to at least partly obviate these drawbacks, the operation of known kilns tends to limit the quantity of cooling air blown on to the material immediately downstream of the high-temperature firing zone.

However, in this manner a cooling curve is obtained which is less steep than the theoretically admissible or optimum curve, with the risk of damaging the material.

Lastly, as a large air throughput is necessary, the cooling air assumes a low and unusable temperature, and is discharged into the outside environment.

As the general consequence of this, there is the further drawback that the kiln cooling zone is very long and bulky.

The excessive length of the cooling zone requires a large number of fans, which make the end part of the kiln extremely complicated and costly. Moreover, such kilns occupy excessive areas which are not always available for a high productivity kiln, to be installed for example in a pre-existing works.

The object of the present invention is to provide a single-layer roller-hearth kiln which by means of a simple and rational design enables a thermal efficiency to be obtained which is close to the optimum efficiency, and allows the theoretical firing curve for each given material to be satisfied as closely as possible, thus also shortening the kiln length.

This object is attained according to the invention by the particular configuration of the end zones of the kiln, in which the initial heating and final cooling of the material take place.

In a kiln constructed according to the invention, the offtake stack for the hot gaseous products of combustion is disposed downstream of the first kiln zone in which the initial material heating takes place. Said first kiln zone is heated by forced circulation of said hot gas, mixed if necessary with atmospheric air for better control.

Because of the particular configuration of the invention, the gas circulated through said first zone can also partly comprise the hot air recovered from the cooling zone, as described hereinafter.

According to the invention, the material is cooled only to a minimum extent by feeding cold air directly on to the tiles immediately at the beginning of the cooling zone, whereas a substantial proportion of the heat is removed from the material by means of an induction heat exchanger.

Substantially, whereas in known kilns all the heat is removed by direct contact between the material and cold air, in the invention only 10–30% is removed by direct contact, whereas 70–90% is removed by induction.

This latter relates to the so-called critical zone, above about 250° C., after which the normal direct blowers are provided in order to reduce the temperature of the material to approximately ambient temperature.

By this means, not only does it become possible to closely control the actual cooling curve, but more particularly the drawbacks deriving from the undesirable spillage of cold air into the immediately upstream kiln zone where high-temperature firing takes place are avoided.

A further advantage of the arrangement suggested by the invention is the availability of high temperature air leaving the cooling zone, which can thus be reused to the advantage of the thermal efficiency of the kiln.

This air can conveniently be reused either within the kiln itself, for example in the initial material heating zone, or as combustion air for the burners, or can be used externally to the kiln, for example in a drier disposed upstream.

According to a further embodiment of the invention, in order to make the cooling curve more controllable, burner means are disposed downstream of the initial cooling zone in which cold air is blown directly on to the tiles, and upstream of the subsequent induction cooling zone, in order to render the tile temperature uniform by localised temperature increase, otherwise the tile temperature would be much lower in the peripheral zones than in the central core.

Lastly, according to the invention the baffles, which are disposed along the path of the gas resulting from the products of combustion inside the tunnel in order to compel said gas to graze the roller table, are constructed in the form of side-by-side adjustable sectors, in order to control the gas flow in the transverse section of the kiln.

These and further constructional and operational characteristics of the invention, together with its merits and advantages, will be apparent from the detailed description given hereinafter by way of non-limiting example of a preferred embodiment thereof, illustrated in the figures of the accompanying drawings, in which.

Figure 1:
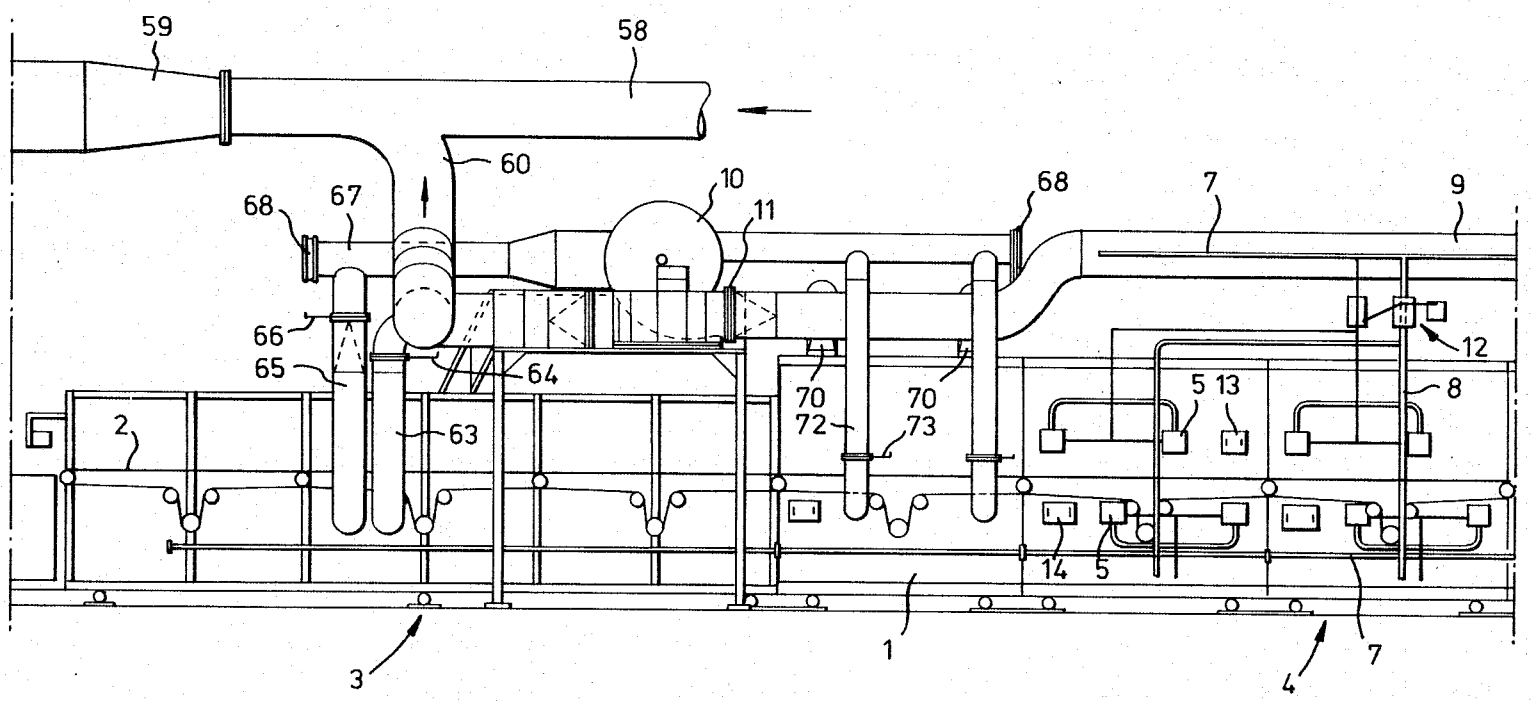
FIG. 1 is a side view of the front end of the kiln.

A horizontal roller table of known type for transferring the material is disposed inside said tunnel, and its component elements pass freely through the side walls of the tunnel, so that their opposing ends emerge from these latter and are connected to suitable support and drive means.

Said support and drive means have not been shown in detail in that they are of known type, and basically comprise two longitudinal opposing rows of pairs of wheels for supporting the rollers, a chain 2 for driving one of said two longitudinal rows of pairs of wheels by way of suitable sprockets, and a drive unit for said chain.

The tiles to be fired are loaded on to the roller table in a longitudinal alignment, and originate from a suitable apparatus of the production plant, for example a vertical preheater.

Starting from its upstream or loading end, the tunnel 1 comprises a zone 3 in which heating of the material begins and proceeds up to about 360° C. (FIG. 1), followed by a high-temperature firing zone in which the material rapidly reaches its firing temperature of about 1200° C., and which is of sufficient length to give the material a residence time which ensures the required firing in relation to the material quality, in accordance with known methods.

Although not shown, between each pair of modules (i.e. about every 4 meters) of the combustion zone 4 of the tunnel 1, there is provided a transverse baffle covering the entire opening of the tunnel except for a horizontal gap for the passage of the roller table and material.

Specifically, each baffle comprises an upper diaphragm and a lower diaphragm, the upper diaphragm according to the invention being divided into a set of vertical strips which can each be adjusted in level. This enables the volumes of hot gas which graze the walls associated with the burner flames to be displaced or guided, so that they become directed into relatively cooler zones. This results in a more uniform distribution or mixing of the gaseous products of combustion. As can be seen in FIGS. 1, 2, 3 and 4, each side wall of each module of the combustion zone 4 comprises two overlying pairs of gas burners 5, disposed respectively above and below the roller table, and having their component elements offset longitudinally relative to the elements of the other pair. The burners 5 are fed with gas through a suitable set of branches 6 connected to a pair of gas feed headers 7, one for the upper burners and the other for the lower burners. The combustion air for said burners is taken by way of a set of branch pipes 8 from a single upper header 9, which forms the delivery conduit of an electric motor-driven fan 10. This latter is disposed above the zone 3, and draws air in from the atmosphere, but could however be fed for example completely or partly with the hot air recovered from the cooling zone.

A control damper 11 is provided immediately downstream of the electric motor-driven fan 10.

Figure 3:
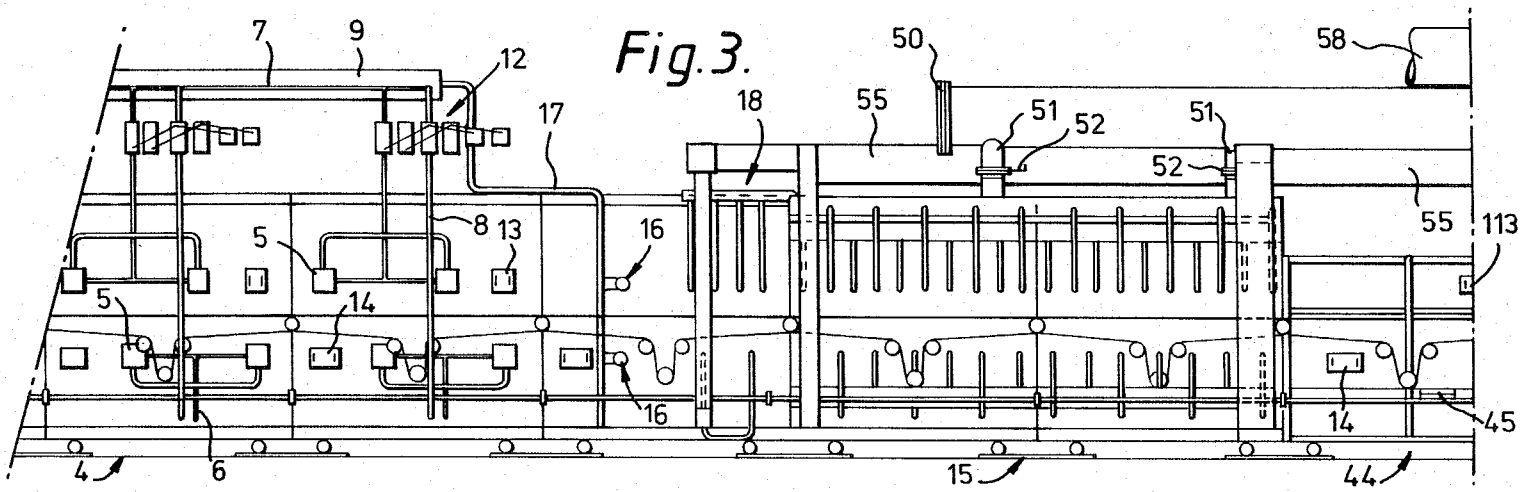
FIGS. 3 and 4 are a side view and the corresponding plan view of the final part of the high-temperature firing zone and of the subsequent cooling zone.

From FIGS. 1 and 3 it can also be seen that each module of the tunnel combustion zone 4 is provided with an automatic control unit 12 for adjusting the operation of the kiln, such as when material gaps exist along the roller table.

Said modules of the combustion zone are also each fitted with a normal plug 13 for visually checking the operation, and a likewise normal cleaning aperture 14.

The end part of the tunnel 1, i.e. that part of this latter located downstream of the combustion zone 4, constitutes the material cooling zone 15 (FIGS. 3, 4, 7 and 8).

Figure 4:
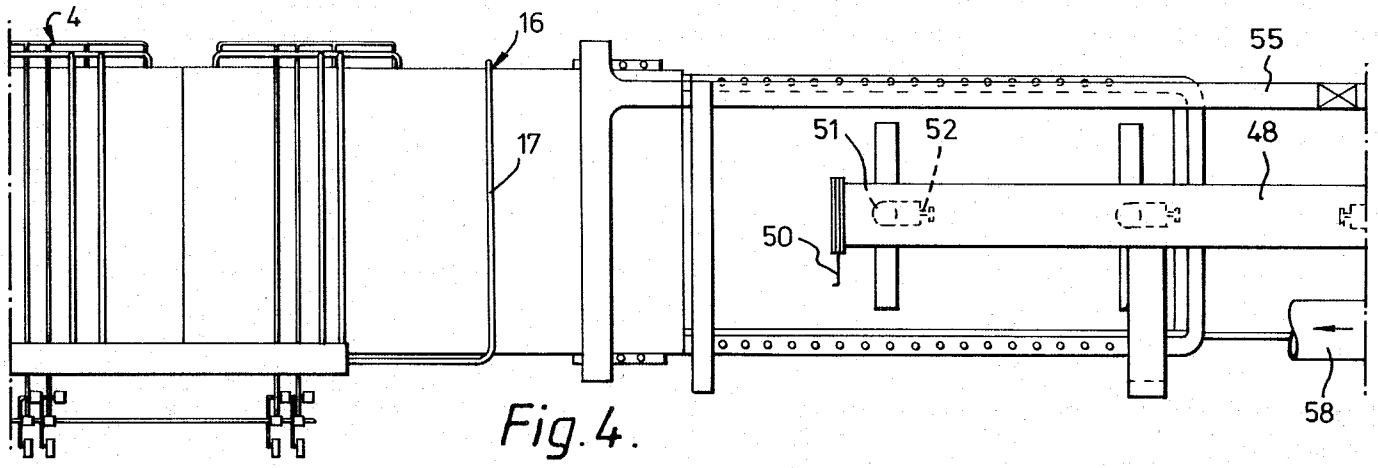

As shown in FIGS. 3 and 4, the upstream end of this latter comprises on each side wall of the tunnel a pair of transverse blowing ports 16 disposed respectively above and below the roller table, and fed by a duct 17 branching from the combustion air header 9 for the burners 5. The number of ports can obviously vary.

Figure 5:
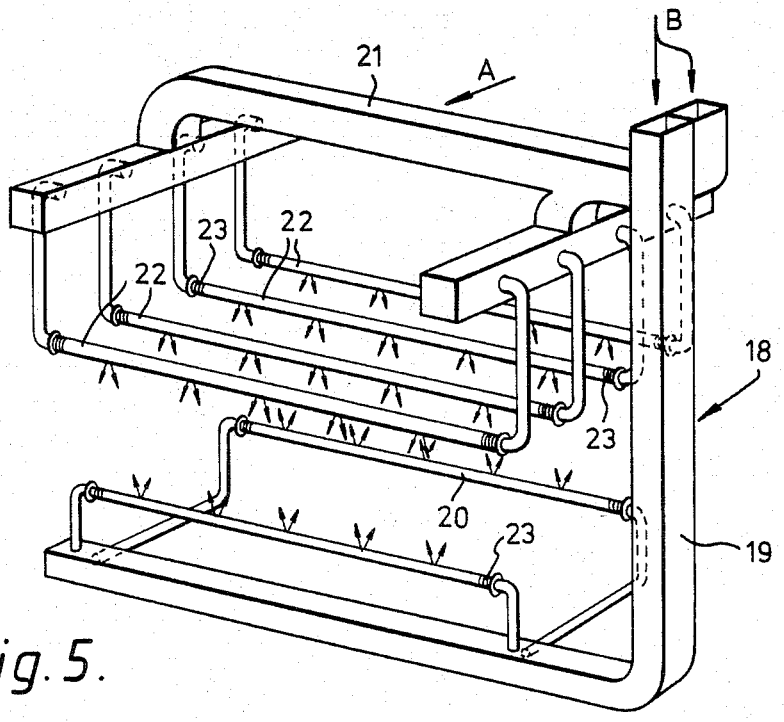
FIG. 5 is a perspective view of the direct cooling device provided in the initial part of said cooling zone.

Transversely to the tunnel immediately downstream of the blowing ports 16 there is disposed a direct acting cooling device 18, shown clearly in FIG. 5, and arranged to strike the fired material with a shower of cold air.

In the aforesaid figure, the reference letters A and B indicate respectively the direction of transfer of the material and the introduction of fresh air into said direct acting rapid cooling device.

This latter comprises a vertically-lying right-angled header 19 disposed transversely to the tunnel, with its vertical portion disposed to the side of the tunnel (FIG. 4) and its horizontal portion below the tunnel.

Two transverse pipes 20 branch from said horizontal portion, and enter the tunnel where they are provided upperly with a set of small upwardly facing through bores.

The rapid cooling device 18 also comprises a horizontally-lying profiled header 21 disposed above the roller table, and comprising, branching from its longitudinal elements, four transverse pipes 22 each provided with a set of downwardly facing small through bores.

Obviously, the number of pipes 20 and 22 and their inner diameters can vary, and at least a proportion of them can also be provided with cocks controllable from the outside. Finally from FIG. 5 it can be seen that the opposing ends of the transverse rectilinear portions of the pipes 20 and 22 are provided with suitable sealing and tensioning members 23, arranged for insertion into the corresponding bores of the tunnel 1 provided for the passage of said pipes.

Figure 6:
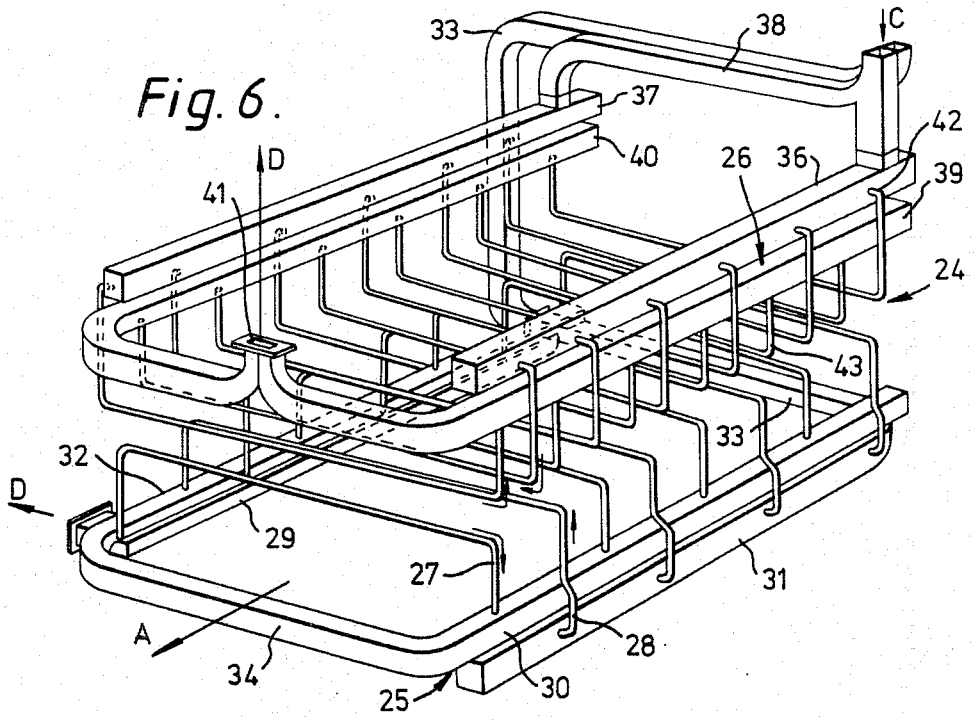
FIG. 6 is a perspective view of the heat exchanger disposed downstream of the device shown in FIG. 5.

Immediately downstream of the described direct action cooling device 18, there is a cooling unit of indirect action 24, clearly shown in FIG. 6.

In said figure, the reference letters A, C and D indicate respectively the direction of transfer of the material, the feed of fresh atmospheric air, and the extraction or recovery of the same air heated after passing through the unit 24. Basically, the cooling unit of indirect action 24 is a heat exchanger comprising two horizontally-lying heat transfer elements 25 and 26, disposed respectively below and above the roller table of the invention.

The lower heat transfer element 25 comprises two tube bundles 27 and 28 disposed transversely to the roller table and having their component elements alternating.

At one end, the tubes of the tube bundle 27 are connected to a first longitudinal fresh air header 29, while at their other end they are connected to a first longitudinal hot air header 30.

Likewise, the tubes of the tube bundle 28 are connected to a second longitudinal fresh air header 31 and to a second longitudinal hot air header 32.

The fresh air headers 29 and 31 are served by a feed duct 33, and the hot air headers 30 and 32 are connected together by a transverse duct 34 and terminate in a discharge port 35.

It will be apparent that the cooling air moves within the two tube bundles 27 and 28 in the two opposing transverse directions, thus ensuring uniform cooling over the entire width of the roller table.

The same also happens in the case of the upper heat transfer element 26, which although having a greater number of tubes than the heat exchange element 25, is configured as this latter. In this respect, the heat transfer element 26 comprises a first and second longitudinal fresh air header 36 and 37 served by a feed duct 38, and a first and second longitudinal hot air header 39 and 40, terminating in a common discharge port 41.

Finally, the headers 36 and 40 are connected together by a transverse tube bundle 42, of which the component tubes alternate with those of a tube bundle 43 which connects together the headers 37 and 39.

The fresh air and hot air which circulate through the direct cooling device 18 and through the indirect cooling unit 24 flow through ducts described hereinafter.

Figure 7:
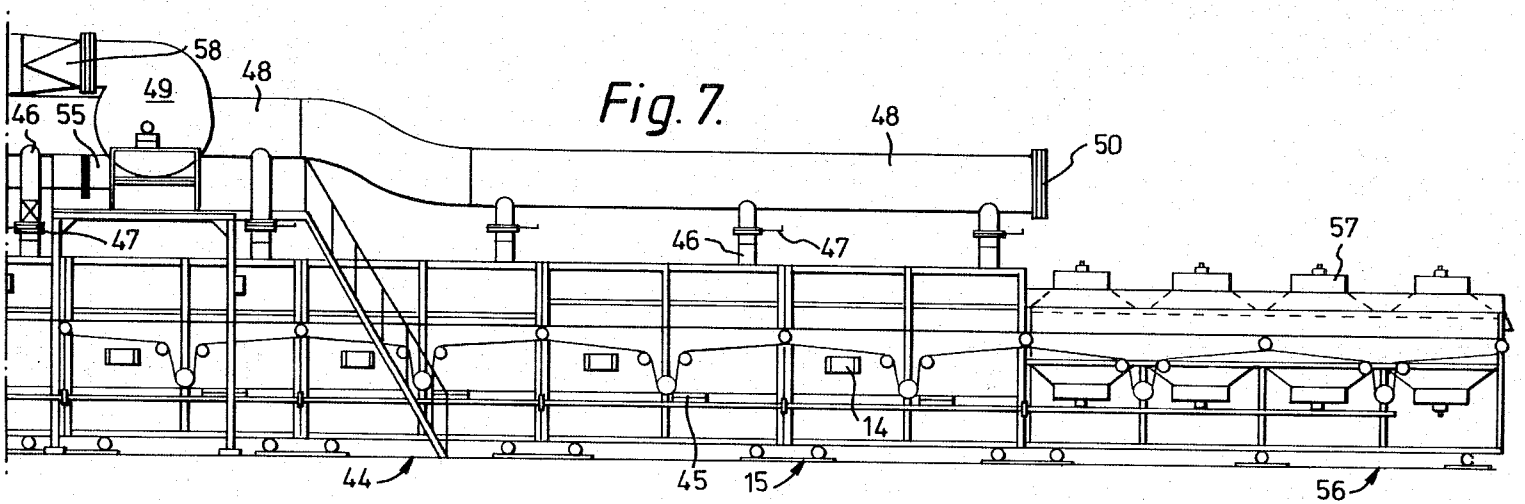
FIGS. 7 and 8 are a side view and the corresponding plan projection of the rear end of the kiln, respectively. Said figures show that the kiln according to the invention comprises a horizontal tunnel 1 of refractory material, composed of a plurality of aligned modules connected together by suitable expansion joints.
Figure 8:
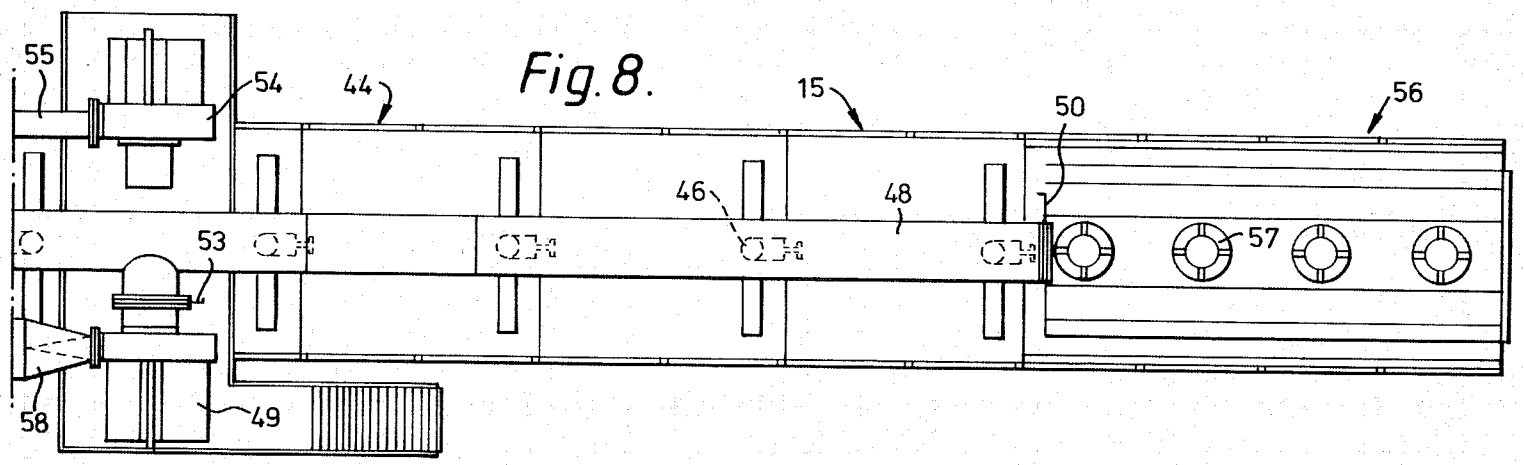

As shown in FIGS. 3, 4, 7 and 8, downstream of the unit 24 there is provided along the tunnel 1 a forced cooling section 44 which comprises in each lower wall of each module an adjustable aperture 45 for the passage of atmospheric air. In addition, at the top of each module of said forced cooling section 44 there is a pipe 46 provided with an automatic control damper 47 and connected into an overlying suction conduit 48 of a corresponding suction fan unit 49 (FIG. 8).

The downstream and upstream ends of said suction conduit 48 are each provided with a damper 50 to enable the air extracted from the kiln to be diluted with atmospheric air if required. As shown in FIGS. 3 and 4, the upstream end part of the conduit 48 extends until it lies above the described unit 24, where it is connected to the hot air discharge ports 35 and 41 (FIG. 6) by way of two branches 51 and two automatic control dampers 52.

A further control damper 53 is disposed between the suction conduit 48 and the corresponding suction fan unit 49 (FIG. 8). To the side of the suction fan unit 49 and at the top of the tunnel there is provided an electric motor-driven fan 54 which draws from the atmosphere and discharges into a longitudinal delivery conduit 55 which extends upstream to serve the fresh air feed ports B and C of the direct action device 18 and indirect action unit 24 respectively, as shown in FIGS. 3 to 8. Immediately downstream of the forced cooling section 44, the invention comprises a final ventilation section 56 (FIGS. 7 and 8).

This comprises two longitudinal sets of four fans 57 each, disposed respectively above and below the roller table. The material is discharged in known manner after the ventilation section 56.

Figure 2:
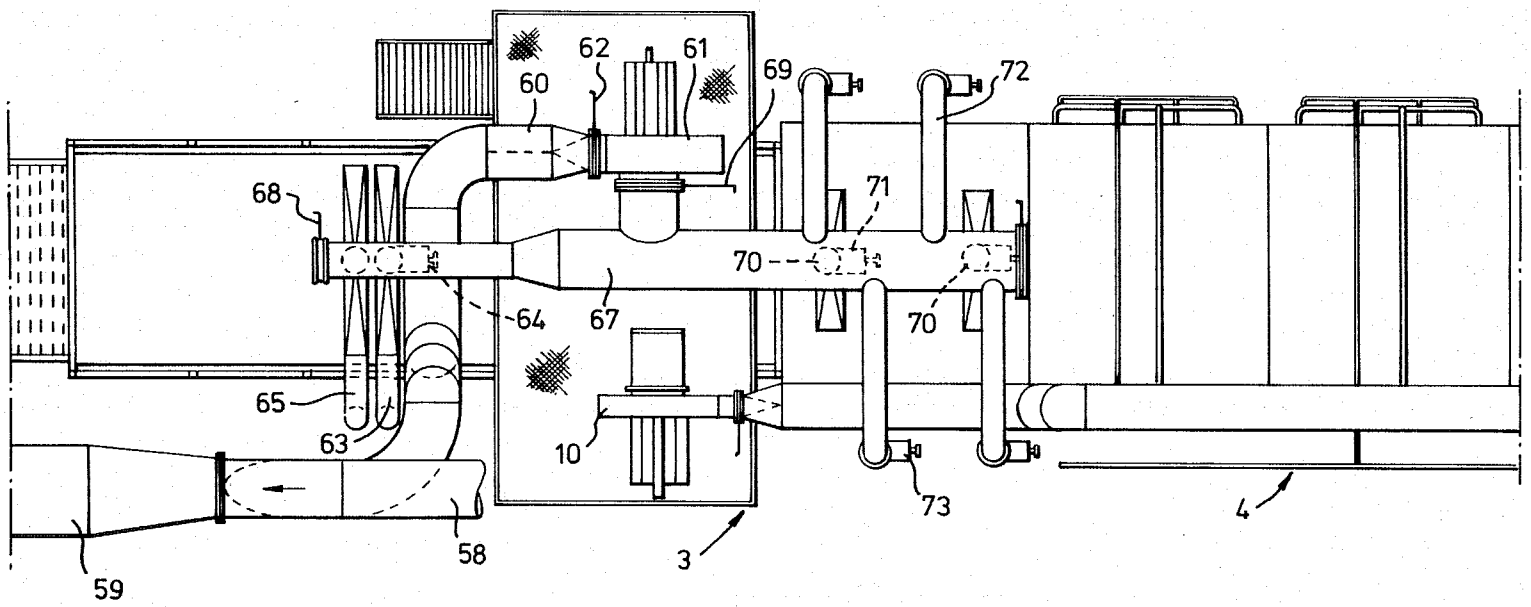
FIG. 2 is a plan projection of the preceding figure.

In the example illustrated, the clean hot air drawn in by the suction fan unit 49 is fed into a delivery conduit 58 which is connected into a stack 59 branching from the tunnel between the zones 3 and 4 (see FIGS. 1 and 2).

The stack 59, which forms the direct extension of the delivery conduit 60 of a suction fan unit 61, can terminate either in the atmosphere or at an apparatus of the corresponding ceramic plant, such as a drier, where the waste heat of the gas is recovered.

Alternatively, the conduit 58 can be connected to the conduit which feeds combustion air to the burners, or can pass by way of suitable control valves into the first zone of the kiln 3. A control damper 62 is connected between the suction fan unit 61 and the respective delivery conduit 60.

In addition, as shown in FIG. 1, a branch 63 provided with a control damper 64 extends from the delivery conduit 60, and is connected into the side of the front portion of the tunnel zone 3, below the roller table.

Immediately upstream of said delivery branch 63, there is provided a suction branch 65 into which a control valve 66 is connected, and which is connected into the tunnel 1 substantially at the level of the branch 63.

The branch 65 is connected upperly to the suction conduit 67 of the suction fan unit 61. The suction conduit 67 is provided with a damper 68 at each of its ends to enable the products of combustion to be diluted with atmospheric air if required, a control valve 69 being connected between the conduit 67 and the suction fan unit 61.

In addition, two vertical pipes 70 each provided with a control damper 71 are connected into the bottom of the downstream terminal portion of the suction conduit 67, and are also connected to the top of the terminal downstream portion of the kiln zone 3.

Two right angled conduits 72 each provided with a control damper 73 are connected into each side of the suction conduit 67 in proximity to the vertical pipes 70, and extend downwards where they are connected into the corresponding side wall of the tunnel below the roller table immediately upstream of the combustion zone 4.

The conduits 70 and 72 draw the gaseous products of combustion from the tunnel.

The operation of the described invention is apparent from the detailed description given heretofore.

It is necessary only to state that the advantageous provision of the delivery branch 63 and suction branch 65 enable the kiln zone 3 to be subjected to a blowing action without influencing the pressure existing upstream in the combustion zone 4. In this respect, the hot air fed to the front of the kiln through the branch 63 is partly drawn in by the branch 65, and the remainder is evacuated through the pipes 70 and right angled conduits 72 together with the gaseous products of combustion drawn countercurrently to the transfer direction of the material. It should also be noted that the pressure in the combustion zone 4 is hardly influenced or varied, as in the case of known kilns, by the direct cooling air fed into the kiln through the blowing ports 16 and the shower device 18.

This lack of influence of the direct cooling air on the pattern of the downstream pressures in the combustion zone is due on the one hand to the small quantity of air fed, and on the other hand to its practically total extraction by the suction fan unit 49.

This prevents the undesirable spillage of cold air into the high temperature firing zone.

The suction fan unit 49 also extracts the air entering through the apertures 45, and the air which is forcibly fed by the final cooling fans 57.

By this means, the zone downstream of the kiln firing zone is not subjected to overpressure, thus improving the possibility of controlling said kiln, for example when there are temporary gaps in the material along the roller table.

Finally, the particular arrangement of the suction ports of the suction fan unit 61, the advantageous presence of the branches 63 and 65, and the combined action of the blowing ports 17, the direct action cooling device 18, the indirect action cooling unit 24 and the final cooling sections 44 and 56 enable a firing curve to be obtained which approximates better to the optimum firing curve for the material than that which has been obtained up to the present time by the previously mentioned known roller-hearth kilns.

This also enables the overall length of the kiln according to the invention to be substantially shortened relative to a known roller-hearth kiln, for equal productivity rates. One temperature pattern obtainable in the cooling zone by virtue of the invention is as follows:

a temperature of about 1170° C. at the outlet of the firing zone a temperature of about 800° C. immediately downstream of the direct cooling device 18 a temperature of about 700° C. immediately downstream of the indirect cooling device 24 the temperature then falling linearly to 250° C. at the outlet of the forced cooling section 15 to then fall suddenly to 60° C. in the rapid cooling zone 56.

The clean hot recovered air fed to the conduit 58 has a temperature of about 150°–250° C.

To improve temperature uniformity in the tile interior (core) relative to its peripheral zones, the invention provides for heat generating means such as burners 113 in the cooling zones. In the illustrated example, said burners 113 are disposed downstream of the cooling device 24 (where the material temperature is about 700° C.), and lead to advantageous tempering of the material.

We claim:

1. A ceramic kiln through which objects to be baked are moved by a conveyor, said kiln comprising a preheating zone, a baking zone downstream of the preheating zone, burner means in said baking zone for baking objects moving through the baking zone, a cooling section downstream of the baking zone and comprising in succession, a fast cooling zone, an induction cooling zone, an air cooling zone, and a fan cooling zone, said fast cooling zone comprising means for directing cold air jets onto objects on the conveyor, said induction cooling zone comprising first and second indirect heat exchanger tube bundles disposed immediately above and below the conveyor for removing heat by conduction to air flowing through tubes of the tube bundles without adding air to the atmosphere in the induction cooling zone of the kiln, each tube bundle comprising coplanar bundles of horizontal transversely extending tubes connected to respective external atmospheric cooling air supply headers and external hot air discharge headers; fan means for supplying atmospheric air to the atmospheric air headers, and control means for controlling the discharge of air from the hot air headers, to control the flow of cooling air through the tubes, said air cooling zone comprising means for admitting cooling air through apertures below the conveyor and means for withdrawing said cooling air from above the conveyor, said fan cooling zone comprising a plurality of fans blowing cooling air toward the conveyor, means for collecting hot gaseous products of combustion from the burner means of the baking zone, and comprising means for withdrawing the hot products of combustion from the baking zone at a location between the preheating zone and the upstream end of the baking zone, means for mixing the hot products of combustion with air and feeding the mixture to the preheating zone, and means for removing cooling air introduced in the fast cooling zone at a location downstream of the fast cooling zone, and upstream of said air cooling zone.

2. A ceramic kiln according to claim 1 wherein said means for removing the fast cooling zone air comprises, means for withdrawing the fast cooling zone air from the induction zone.

3. A kiln according to claim 1 wherein said means for directing cold air jets on to the objects comprise lateral atmospheric air blowing means, two in each side wall of the kiln, in the form of blowing ports directed horizontally and orthogonal to said side walls, and respectively above and below the conveyor, and two sets of parallel side-by-side horizontal pipes disposed transversely to and located respectively above and below the conveyor, said horizontal pipes having bores directed towards the conveyor, the two sets of pipes being connected to two external atmospheric air headers, and fan means for supplying atmospheric air to said headers.

4. A kiln as claimed in claim 1 wherein a first bundle of tubes of each heat exchanger comprises means for conducting cooling air therethrough in a first direction transversely of the kiln, and a second bundle of tubes of each heat exchanger comprises means for conducting cooling air therethrough in a second direction opposite to said first direction.

5. A kiln as claimed in claim 4 wherein individual tubes of each first bundle are respectively between the individual tubes of each second bundle.

6. A kiln as claimed in claim 1 wherein the baking zone is divided into sectors by transverse baffles comprising a central gap for the passage of the conveyor and objects and an upper part of each transverse baffle comprises a series of vertical strips which are adjustable in level.

7. A kiln as claimed in claim 1, further comprising heat generation means in the cooling section, downstream of the induction cooling zone for tempering material in the cooling zone.

8. A ceramic kiln through which objects to be baked are moved by a conveyor, said kiln comprising a preheating zone, a baking zone downstream of the preheating zone, burner means in said baking zone for baking objects moving through the baking zone, a cooling section downstream of the baking zone and comprising in succession, a fast cooling zone, an induction cooling zone, an air cooling zone, and a fan cooling zone, said fast cooling zone comprising means for directing cold air jets onto objects on the conveyor, said induction cooling zone comprising horizontal heat exchanger tube bundles disposed immediately above and below the conveyor for removing heat by conduction to air flowing through tubes of the tube bundles, said air cooling zone comprising means for admitting cold air through apertures below the conveyor and means for withdrawing air from above the conveyor, said fan cooling zone comprising a plurality of fans blowing cooling air toward the conveyor, means for collecting hot gaseous products of combustion from the burner means of the baking zone, and means for mixing the hot products of combustion with air and feeding the mixture to the preheating zone, and wherein said air cooling zone comprises a set of adjustable apertures in the side walls of the kiln below the conveyor, and a set of upper suction pipes disposed at the top of the tunnel and each provided with an automatic control damper, and connected to the suction side of a suction fan unit.

* * * * *